US010220296B1

(12) United States Patent
Colpitts

(10) Patent No.: US 10,220,296 B1
(45) Date of Patent: Mar. 5, 2019

(54) SCORE TRACKING DEVICE FOR BILLIARDS

(71) Applicant: Craig A. Colpitts, LaSalle, CO (US)

(72) Inventor: Craig A. Colpitts, LaSalle, CO (US)

( * ) Notice: Subject to any disclaimer, the term of this patent is extended or adjusted under 35 U.S.C. 154(b) by 0 days.

(21) Appl. No.: 15/792,853

(22) Filed: Oct. 25, 2017

(51) Int. Cl.
*A63B 71/06* (2006.01)
*A63D 15/00* (2006.01)
*A63D 15/20* (2006.01)

(52) U.S. Cl.
CPC ..... *A63D 15/20* (2013.01)

(58) Field of Classification Search
CPC ..... A63D 15/20; A63D 15/00; A63D 15/105; A63D 15/003; A63D 15/08; A63D 15/005; A63D 15/006; A63D 15/04; A63D 15/06; A63D 15/14; A63D 15/16; A63D 5/10; A63F 7/307
USPC ..... 235/91
See application file for complete search history.

(56) References Cited

U.S. PATENT DOCUMENTS 670,610 A 3/1901 Gorin
993,994 A 5/1911 Hobbs
4,021,039 A * 5/1977 Hay ..... A63F 7/0652 273/317.4
5,066,008 A * 11/1991 Rivera ..... A63D 15/20 473/23
5,685,779 A * 11/1997 Tsoukalas ..... A63D 15/20 473/1
5,941,778 A * 8/1999 Vasalech ..... A63D 15/00 273/DIG. 24
6,315,675 B1 11/2001 Ho
6,474,648 B1 * 11/2002 Rogers ..... A63D 15/00 273/292
6,644,662 B1 * 11/2003 Cao ..... A63D 15/00 273/123 R
7,690,504 B1 4/2010 Lail
8,961,327 B1 * 2/2015 Hutchinson ..... A63D 15/00 473/20
2008/0125234 A1 * 5/2008 Robledo ..... A63D 15/00 473/52
2011/0127724 A1 * 6/2011 Bouchard ..... F41J 3/00 273/408
2011/0294585 A1 * 12/2011 Penna ..... G07F 17/38 473/1

OTHER PUBLICATIONS

Wooden Scoring Beads Keeper. Product listing [online]. © 2018 Ozone Billiards [retrieved on Aug. 16, 2017]. Retrieved from the Internet: <URL: https://www.ozonebilliards.com/product/wooden-scoring-beads-keeper>.

(Continued)

*Primary Examiner* — Thien M Le
(74) *Attorney, Agent, or Firm* — Cramer Patent & Design, PLLC; Aaron R. Cramer

(57) ABSTRACT

A score tracking device for billiards incorporates a frame assembly further subdivided into three (3) sections, each bisected by a middle frame member. A plurality of balls simulating a scoring means is maintained with each section and traversing along a track. A given position of a ball within a respective track designates a given score in a counting manner. The device is configured with hardware suitable to securing the device from a ceiling, a wall, or being supported on a horizontal support structure.

20 Claims, 7 Drawing Sheets

(56) References Cited

OTHER PUBLICATIONS

Billiard/English Pool Plastic Scoring Device/Scoreboard, Black. Product listing [online]. © 2018 Woods Cues [retrieved on Aug. 16, 2017]. Retrieved from the Internet: <URL: https://www.woodscues.com/products/billiard-english-pool-plastic-scoring-device-scoreboard-black>.

Billiard Parlour Scoreboard. Product listing [online]. © 2018 Ozone Billiards [retrieved on Aug. 16, 2017]. Retrieved from the Internet: <URL: https://www.ozonebilliards.com/product/billiard-parlour-scoreboard>.

* cited by examiner

SCORE TRACKING DEVICE FOR BILLIARDS

RELATED APPLICATIONS

Not applicable.

FIELD OF THE INVENTION

The present invention relates to a score tracking device associated with billiards capable of being supported in different orientations.

BACKGROUND OF THE INVENTION

Billiards continually ranks among the most popular of the recreational/sporting activities that many people enjoy. Ranging in intensity from the casual type that shoots pool periodically to the serious shooter that plays several times a week, thousands of people play pool every day. As is common with all sports and hobbies, the participant strives for continual improvement and refinement. While practice and coaching from more advanced players will certainly help in this regard, there is lack of products on the market to help the pool player. This is in stark contrast to other sports such as golf, baseball, soccer, football and the like whose products and training aids fill virtually all sporting goods stores.

Certain attempts in the past have been made to achieve such a means to easily track the scoring of games associated with billiards. Such attempts have been made by the Billiard Plastic Scoring Device available at https://www.woodscues.com/products/billiard-english-pool-plastic-scoring-device-scoreboard-black, the Billiard Parlour Scoreboard from Ram Gameroom Products, Co. available at http://www.ozonebilliards.com/billiard-parlour-scoreboard.html and the Wooden Scoring Beads Keeper available at http://www.ozonebilliards.com/woodscorbead.html.

Accordingly, there is a continual need for new and innovative features and improvements that will serve to enhance the game of billiards. The development of the score tracking device for billiards fulfills this need.

SUMMARY OF THE INVENTION

The principles of the present invention provide for a device that enables easy manipulation of a score tracking device during a game of billiards. In separate embodiments, the score tracking device can be mounted to a ceiling, mounted on a vertical support surface, or stand on a horizontal support surface. The device can incorporate the mounting of a light fixture and provide means to conceal the routing of electrical wiring thereto.

It is therefore an object of the present invention to provide such a device including a frame assembly, comprising an upper member, a middle member, a lower member, a first end vertical member interconnecting first ends of each said upper member, middle member, and lower member. Further, a second end vertical member interconnects second ends of each upper member, middle member, and lower member, a first intermediate member interconnects a first intermediate position of each upper member, middle member, and lower member, and a second intermediate member interconnects a second intermediate position of each upper member, middle member, and lower member. An area bound between the upper member, lower member, first end vertical member, and the first intermediate member is defined as a "hundreds" section. An area bound between the upper member, lower member, first end intermediate member, and second intermediate member is defined as a "tens" section. An area bound between the upper member, lower member, second end vertical member, and second intermediate member is defined as a "ones" section. The middle member bisects the "hundreds" section, "tens" section, and "ones" section. A plurality of upper "hundreds" balls are each captured within and capable of traversing along the "hundreds" section located above the middle member. A plurality of lower "hundreds" balls are each captured within and capable of traversing along the "hundreds" section located below the middle member. A plurality of upper "tens" balls are each captured within and capable of traversing along the "tens" section located above the middle member. A plurality of lower "tens" balls are each captured within and capable of traversing along the "tens" section located below the middle member. A plurality of upper "ones" balls are each captured within and capable of traversing along the "tens" section located above the middle member. A plurality of lower "ones" balls are each captured within and capable of traversing along the "tens" section located below the middle member. In a preferred embodiment, the "ones" section and "tens" section are identical in area.

Another object of the invention that helps the maintain the balls in their proper sections is a first track located along a lower surface of the upper member and a second track located along an upper surface of the middle member. The first and second tracks are coaligned. Also present is a third track located along a lower surface of said middle member and a fourth track located along an upper surface of said lower member. The third and fourth tracks are coaligned.

Yet another object of the invention that helps the maintain the balls in their proper sections is a first upper plurality of equidistantly spaced depressions located along the second track within the "hundreds" section, each capable of retaining one (1) of the plurality of upper "hundreds" balls therein, a second upper plurality of equidistantly spaced depressions located along the second track within the "tens" section, each capable of retaining one (1) of the plurality of upper "tens" balls therein, a third upper plurality of equidistantly spaced depressions located along the second track within the "ones" section, each capable of retaining one (1) of the plurality of upper "ones" balls therein, a first lower plurality of equidistantly spaced depressions located along the fourth track within the "hundreds" section, each capable of retaining one (1) of the plurality of lower "hundreds" balls therein, a second lower plurality of equidistantly spaced depressions located along the fourth track within the "tens" section, each capable of retaining one (1) of the plurality of lower "tens" balls therein, and a third lower plurality of equidistantly spaced depressions located along the fourth track within the "ones" section, each capable of retaining one (1) of the plurality of lower "ones" balls therein. The depressions are spaced such that adjacent balls are not in contact.

It is another object of the present invention to provide a first upper reinforcing member affixed between the upper member, middle member, and first end vertical member, a first lower reinforcing member affixed between the lower member, middle member, and first end vertical member, a second upper reinforcing member affixed between the upper member, middle member, and second end vertical member, and a second lower reinforcing member affixed between the lower member, middle member, and second end vertical member. In other certain embodiments, a bonnet is affixed to the upper member.

Yet a further object of the present invention, in embodiments where a light fixture capable is present is to provide an upper wire channel located along an upper surface of the upper member (or bonnet if one (1) is present), a first end wire channel located along a vertical bisecting centerline within the first end vertical member and in fluid communication with the upper wire channel, and a second end wire channel located along a vertical bisecting centerline within the second end vertical member and in fluid communication with the upper wire channel.

Still yet a further object is to provide a plurality of mounting brackets attached to a rear side of said upper member (or bonnet if one (1) is present) in embodiments where the device is meant to be mounted upon a vertical support structure.

Still yet a further object is to provide at least one (1) stand attached to a bottom of the lower member in embodiments where the device is meant to be supported on a horizontal support structure.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
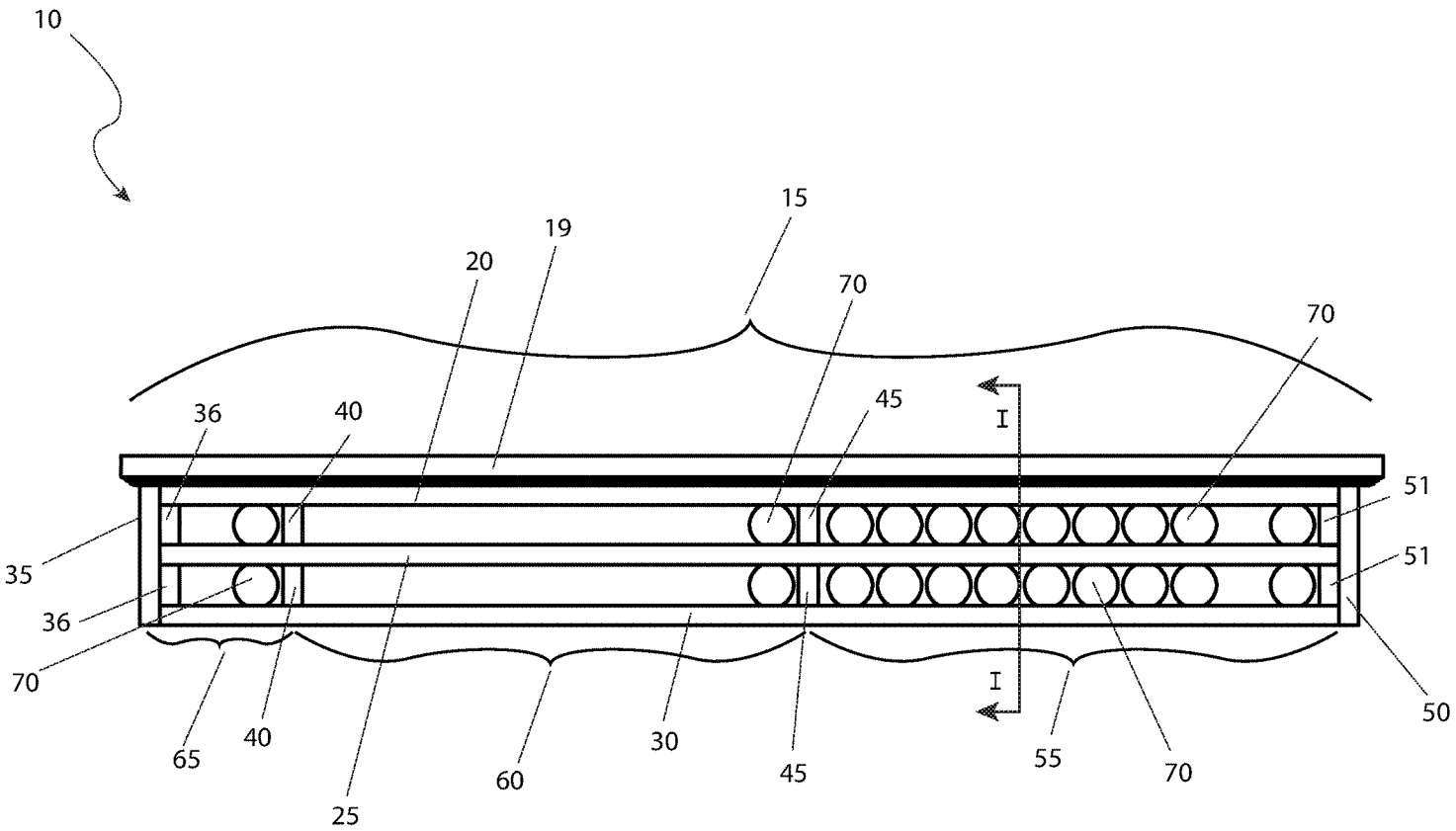
FIG. 1 is a front view of a score tracking device for billiards 10, according to the preferred embodiment of the present invention.

10 score tracking device for billiards
15 frame assembly
19 bonnet
20 upper member
25 middle member
30 lower member
35 first end vertical member
36 first end reinforcing member
40 first intermediate member
45 second intermediate member
50 second end vertical member
51 second end reinforcing member
55 "ones" section
60 "tens" section
65 "hundreds" section
70 billiard ball
75 track
76 depression
80 electrical junction box
85 ceiling surface
90 electrical wiring
95 first wire channel
96 second wire channel
97 third wire channel
100 billiard table
101 stand
105 light fixture
106 inlay
110 support chains
115 wall surface
120 wall mounting brackets
125 personal items

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a front view of the score tracking device for billiards 10, according to the preferred embodiment of the present invention is disclosed. The score tracking device for billiards 10 (herein also described as the "device") 10, includes a frame assembly 15 made from wood, plastic or similar material. It is approximately sixty inches (60 in.) long, seven inches (7 in.) tall, and two and a half inches (2½ in.) wide, in order to accommodate a typical-sized billiards ball. The frame assembly 15 is comprised of an upper member 20, a middle member 25, and a lower member 30, interconnected by a first end vertical member 35, a first intermediate member 40, a second intermediate member 45 and a second end member 50. Standard wood forming and joining methods would be utilized for wood construction, plastic injection molding would be utilized for plastic manufactured units. Other manufacturing methods particular to other materials of construction are well known in the art and would be utilized as applicable. Such other methods may include a pair of first end reinforcing members 36, each affixed or otherwise attached to inner surfaces of the first end vertical member 35. The pair of first end reinforcing members 36 are located on the upper and lower sides of the middle member 25. Another method may include a pair of second end reinforcing members 51, each affixed or otherwise attached to inner surfaces of the first end vertical member 50. The pair of second end reinforcing members 51 are located on the upper and lower sides of the middle member 25. Yet another method would be to affix or otherwise attach a decorative bonnet 19 onto the upper surface of the upper member 20.

The inner surfaces of the first end vertical member 35, the first intermediate member 40, the second intermediate member 45 and the second end member 50 provide for three (3) discrete storage areas that correspond to numerical integers in the "base 10" number system. As such an "ones" section 55, a "tens" section 60, and a "hundreds" section 65 are provided. In embodiments where either or both the first end reinforcing members 36 and second end reinforcing members 51 are present, the inner surfaces of such define the sections 55, 60, 65. Multiple billiard balls 70 then slide back and forth along tracks 75*a*, 75*b*, 75*c*, 75*d*. The billiard balls 70 are moved by the player's hands or an extended pool cue to various positions along each section to keep score. Thus, as almost any type of billiard game is being played, players can simply reach up with their cue stick and move the billiard balls 70 to indicate the current score. At the completion of play, the billiard balls 70 are simply reset to be used again and again. Finally, the players may change the arrangement or positioning between the billiard balls 70 to allow for scoring higher than 200. Additional intermediate vertical members may be added or extended to allow for higher or different scoring methods. As such the quantity and/or positioning of intermediate vertical members is not intended to be a limiting factor of the present invention.

Figure 2:
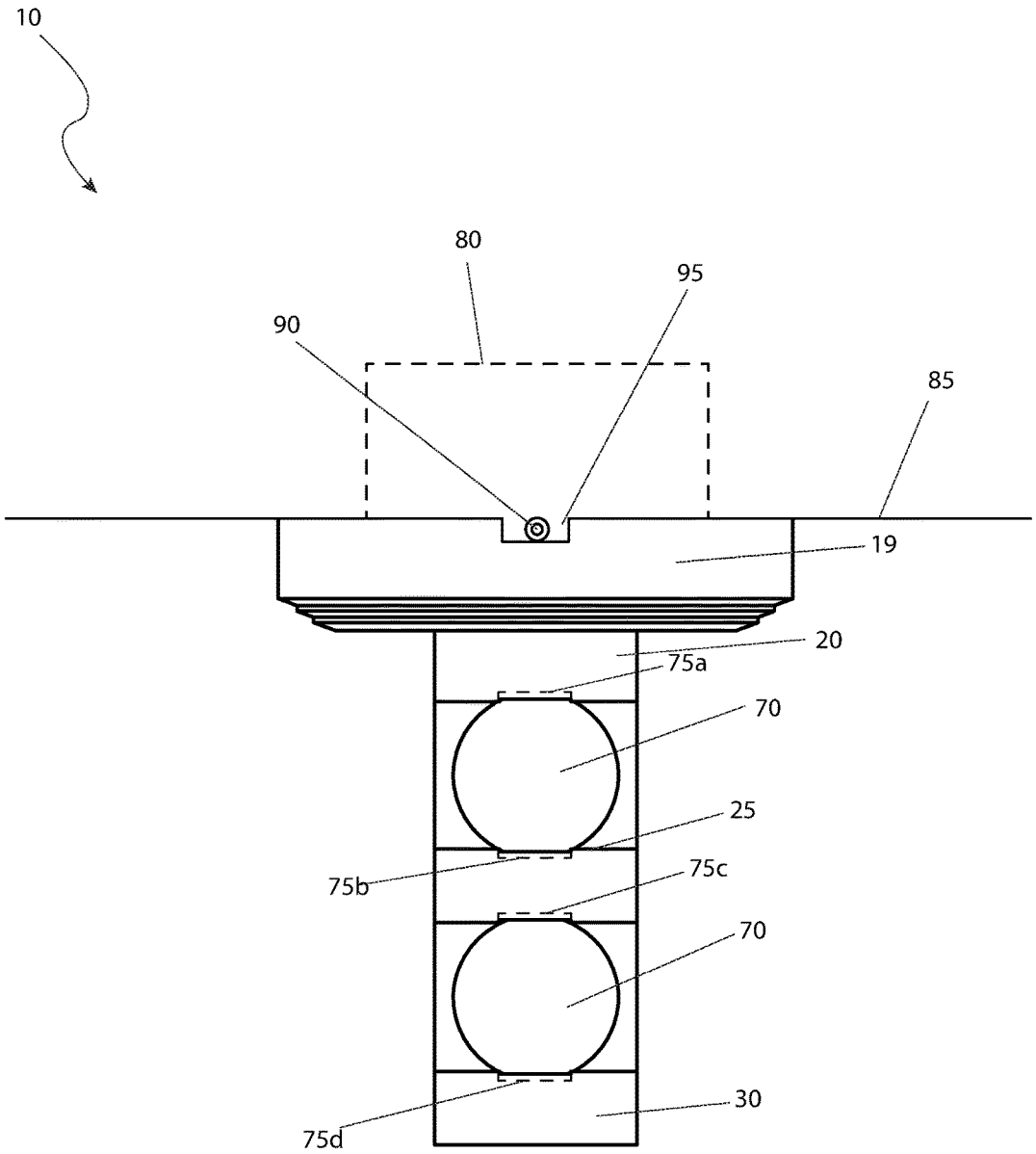
FIG. 2 is a sectional view of the score tracking device 10, as seen along a line I-I, as shown in FIG. 1, according to the preferred embodiment of the present invention.
Figure 3:
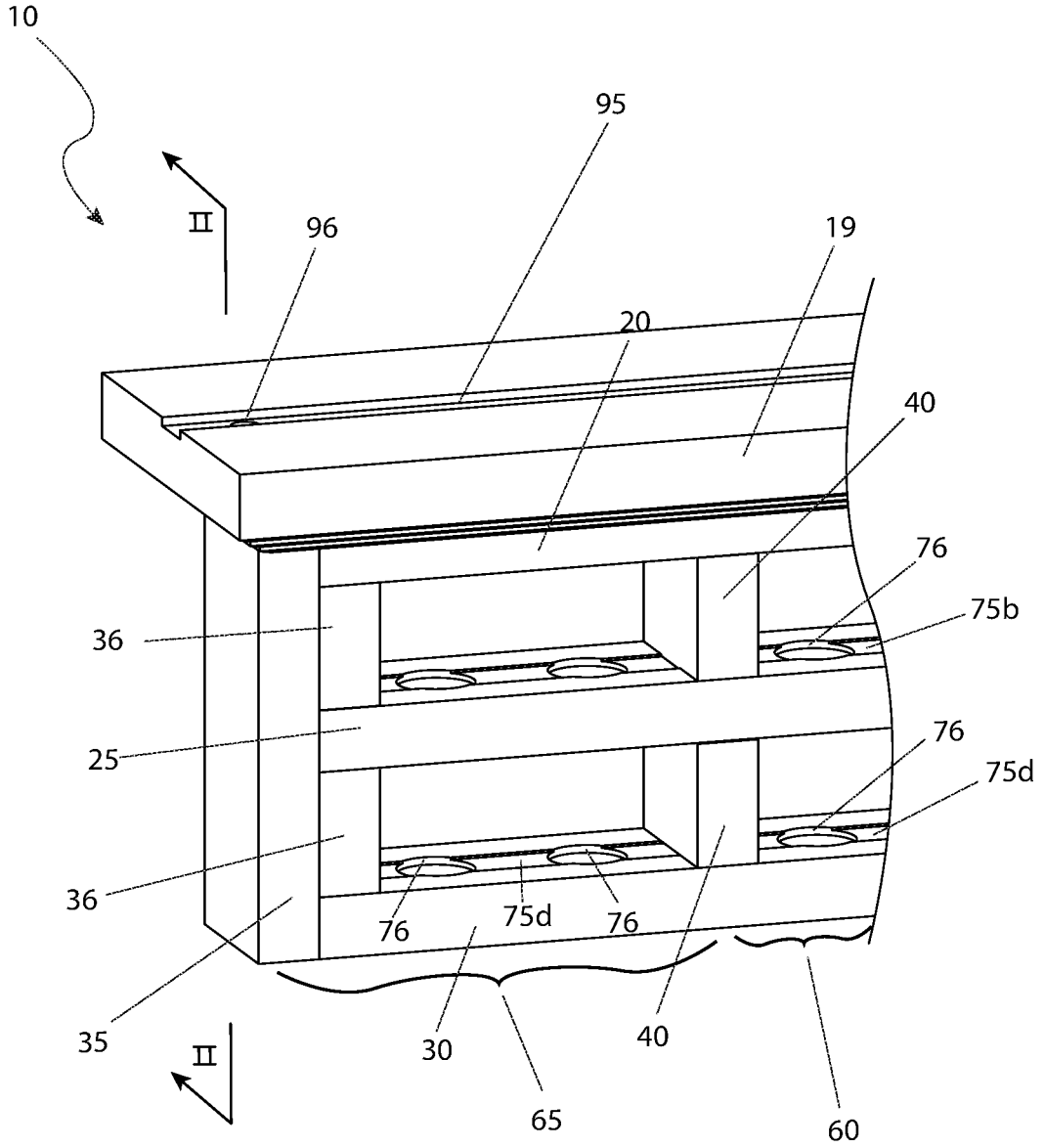
FIG. 3 is a partial perspective view of the score tracking device 10 illustrating of the "hundreds" section 65, according to the preferred embodiment of the present invention.

Referring next to FIG. 2, a sectional view of the device 10, as seen along a line I-I, as shown in FIG. 1, and FIG. 3, a partial perspective view of the "hundreds" section 65, is depicted. This figure provides knowledge on placement of the billiard balls 70 within the tracks 75*a*, 75*b*, 75*c*, 75*d*. A first track 75*a* located at a longitudinal center of the lower surface of the upper member 20, a second track 75*b* located at a longitudinal center on the upper surface of the middle member 25, a third track 75*c* located at a longitudinal center on the lower surface of the middle member 25, and a fourth track 75*d* located at a longitudinal center on the upper surface of the lower member 30. The first track 75*a* and second track 75*b* are coaligned. Similarly, the third track 75*c* and fourth track 75*d* are coaligned. The tracks 75*a*, 75*b*, 75*c*, 75*d* may be provided by slots, raised rails, or curved surfaces as shown. The tracks 75*a*, 75*b*, 75*c*, 75*d* can be continuous along the entirety of the respective member 20, 25, 30, or they may terminate at the respective vertical or reinforcing member 35, 36, 40, 45, 50, 51. Such placement ensures that the billiard balls 70 are held captive and cannot fall from the frame assembly 15 (as shown in FIG. 1). A plurality of depressions 76 are equally spaced along the length of each of the tracks 75*a*, 75*b*, 75*c*, 75*d* and are capable of retaining a billiard ball 70 therein. The distance between adjacent depressions 76 should be of such a distance as to enable adjacent billiard balls 70 from not touching each other.

If a bonnet 19 is present, it is provided with a wider profile than the upper member 20, middle member 25, and lower member 30. Such a profile allows for covering an electrical junction box 80 in a ceiling surface 85 such as typically expected over a billiard table for a billiard table light fixture. Such an arrangement will be expanded in further detail herein below. Electrical wiring 90 for a light fixture 105 can be routed from the electrical junction box 80 to said light fixture 105 through a plurality of wire channels 95, 96, 97. In a preferred embodiment, the first wire channel 95 is located along a longitudinal centerline of the upper surface of the bonnet 19, intended to be concealed when the upper member 20 or bonnet 19 is installed on a ceiling. In instances where the bonnet 19 is not present, the first wire channel 95 is located in an analogous position on the upper surface of the upper member 20. In a preferred embodiment, the first wire channel 95 and tracks 75*a*, 75*b*, 75*c*, 75*d* each comprise a rectangular cross section. Other geometrical shapes are possible. While not necessary, the ornate appearance of the device 10 could match that of the billiard table 100 and/or billiard table light fixture 105. Availability at multiple pricing levels from low cost basic units to high end units sold with billiard table 100 and light fixture 105 are envisioned.

Figure 4:
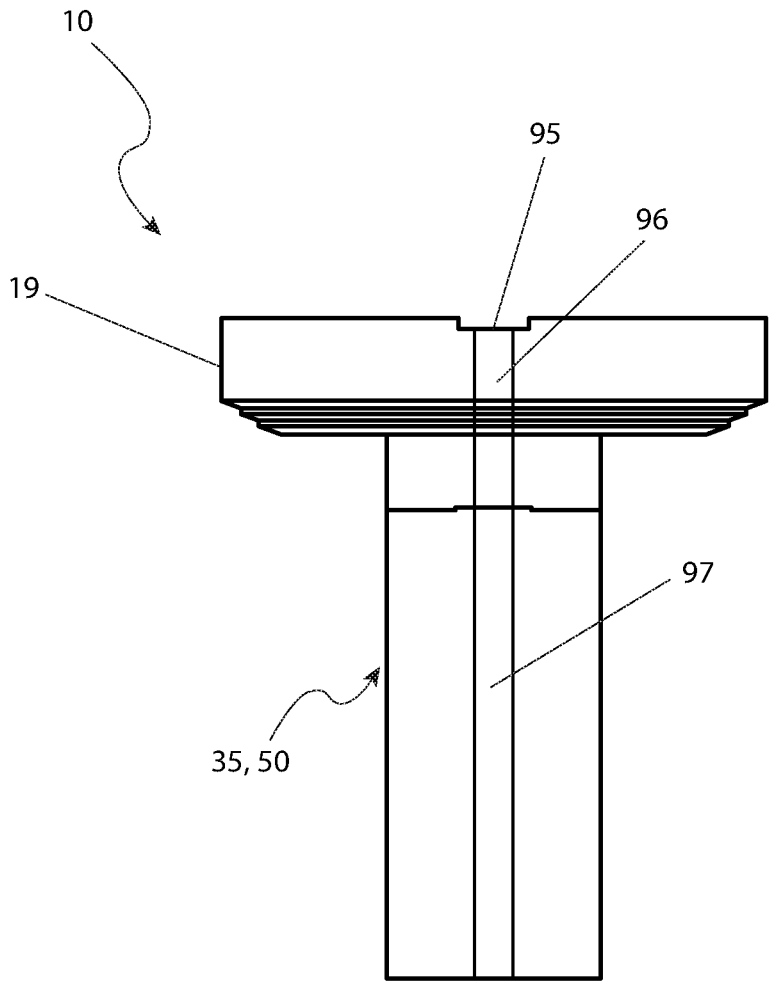
FIG. 4 is a sectional view of either the first end vertical member 35 or the second end vertical member 50, as seen along a line II-II, as shown in FIG. 3, according to the preferred embodiment of the present invention.

FIG. 4 illustrates a cross-sectional view of both the first end vertical member 35 and the second end vertical member 50. The bonnet 19 (or instances where there is no bonnet 19, the upper member 20) also has a pair of second wire channels 96, each oriented perpendicular to and each in fluid communication with the first wire channel 95. The second wire channels 96 extend the entire height of the bonnet 19 (or upper member 20) and are positioned to be aligned with a third wire channel 97 located in each of the first end vertical member 35 and second end vertical member 50. The third wire channels 97 are each coextensive with and are centrally-located pass-through apertures in the respective first end vertical member 35 and second end vertical member 50. As the first wire channel 65, the third wire channels 97 are preferably rectangular cross-section but can be other geometrical shapes. The third wire channels 97 are envisioned to be located in a such a position on the bottoms of the respective first end vertical member 35 and second end vertical member 50 to be adjacent to the support chains 110 that support the light fixture 105.

Figure 5:
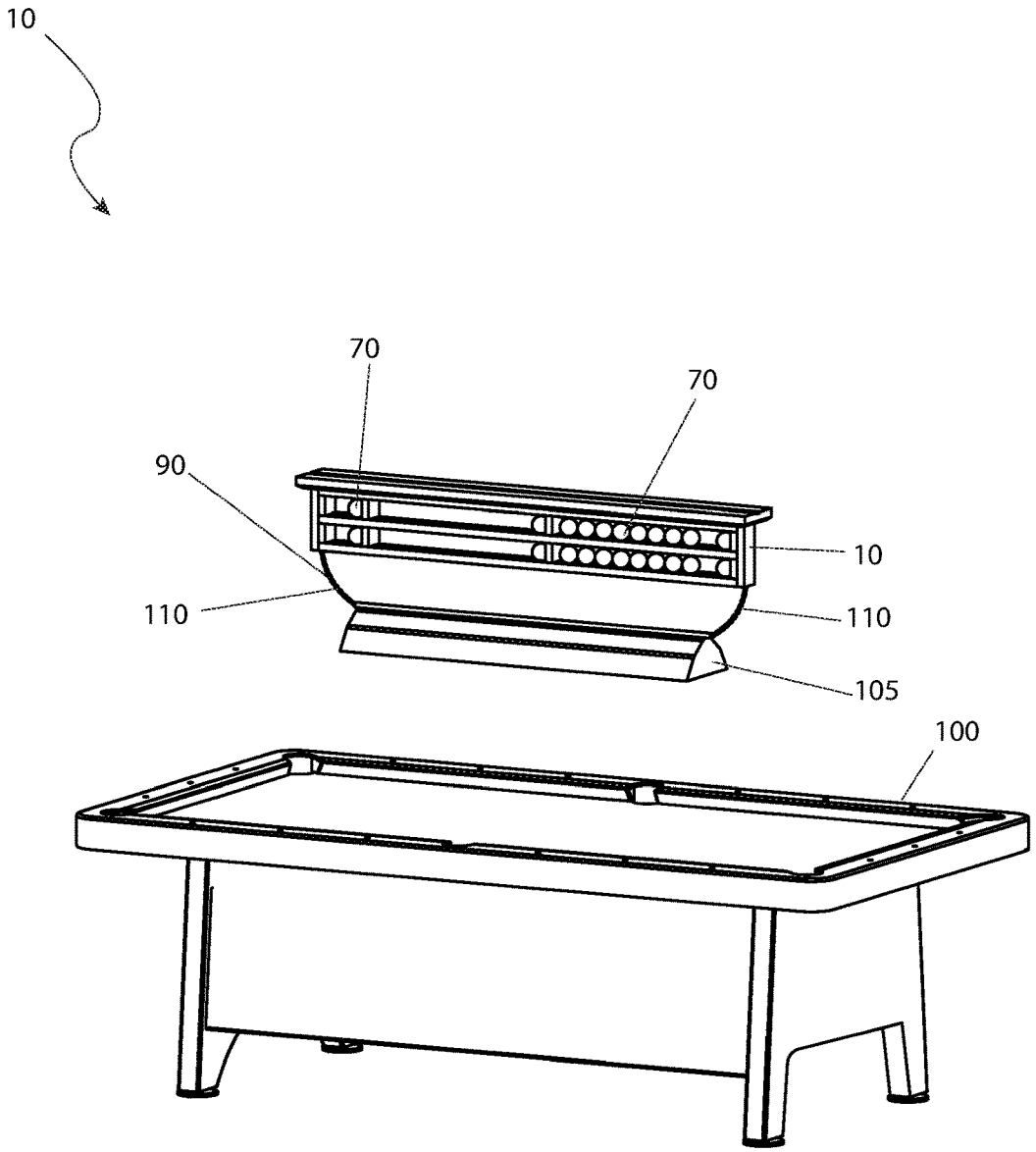
FIG. 5 is a perspective view of the score tracking device 10, shown in a utilized state over a billiard table 100, according to the preferred embodiment of the present invention.

Referring now to FIG. 5, a perspective view of the device 10, shown in a utilized state over a billiard table 100, according to the preferred embodiment of the present invention is shown. The device 10 is mounted directly to a ceiling surface 85 (not shown in this figure due to illustrative limitations), typically at the upper surface of the bonnet 19 or upper member 20. A light fixture 105 is mounted to the bottom surface of the lower member 30 (or alternately either the bottoms of the first end vertical member 35, second end vertical member 50, or both) in a preferred embodiment using two (2) or more support chains 110. Preferably, any position on the bottom of the device 10 would suffice. The electrical wiring 90, flexible in nature, and rated for the application is routed through the first wire channel 95, second wire channel 96, and third wire channel 97 to provide electrical communication between the light fixture 105 and the electrical junction box 80. The electrical wiring 90 may be run along the support chains 110 and possibly supported thereon. Such positioning allows easy access to the billiard balls 70 on the device 10 via tips of pool cues, held by the players, and used to move the billiard balls 70 into different positions representing different scores. Access may be provided on both sides of the device 10.

Figure 6:
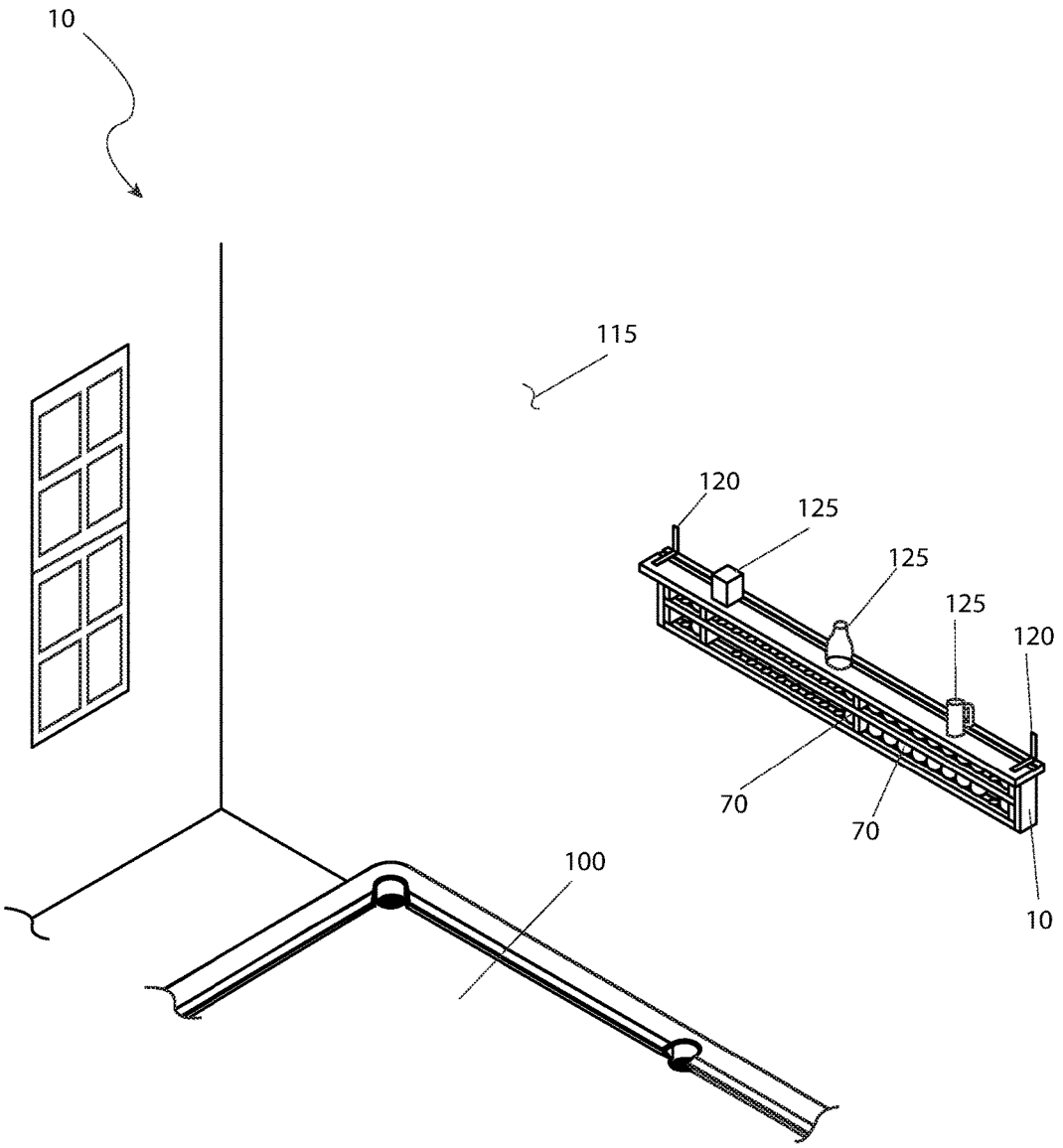
FIG. 6 is a perspective view of the score tracking device 10, shown in a utilized state mounted on a wall surface 115, according to the preferred embodiment of the present invention; and, FIG. 7 is a side elevation view of a stand 101, according to an alternate embodiment of the present invention.

Referring to FIG. 6, a perspective view of the device 10, shown in a utilized state mounted on a wall surface 115, according to the preferred embodiment of the present invention is disclosed. A plurality of wall mounting brackets 120 are attached to the lower surface or upper surface (as shown) to the bonnet 19 (or the upper member 20) using conventional fasteners such as screws, clips, anchors or the like. Such an arrangement allows access to one (1) side of the device 10 for purposes of moving the billiard balls 70 to facilitate billiard game scoring. Additionally, the top surface of the bonnet 19 (or upper member 20) provides a flat surface for the purposes of personal items 125 such as vases, decorations, beverage glasses or the like. The wall mounting as shown in this figure will be utilized in locations where ceiling mounting is not feasible while still allowing easy access when utilizing a billiard table 100.

Figure 7:
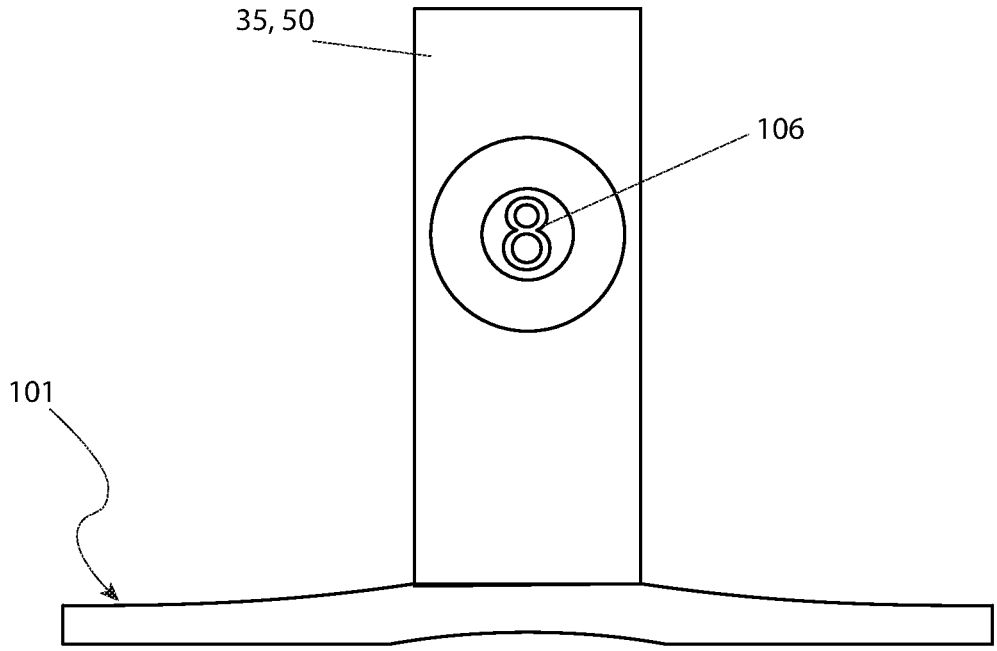

Alternately, FIG. 7, illustrate a side elevation view of the device 10 showing a stand 101, according to an alternate embodiment of the invention. The stand 101 is affixed to a lower surface of the lower member 20. The stand 101 can be flared out on both device 10 to account for added balance for the fully loaded device 10. It is appreciated that any number of stands 101 can be utilized with the invention to provide proper balance and support for the device 10 on a shelf or other horizontal support structure in lieu of mounting to a wall. Also present in the illustration is the first vertical end member 35 (or second vertical end member 50) and an inlay 106 located within either vertical end member 35, 50. The inlay 106 illustrated herein is a billiard eight-ball, although not intended to be a limitation of the present invention.

The preferred embodiment of the present invention can be utilized by the common user in a simple and effortless manner with little or no training. It is envisioned that the device 10 would be constructed in general accordance with FIG. 1-7. The user would procure the device 10 in a ready-made state complete with billiard balls 70 installed.

After procurement and prior to utilization, the device 10 would be prepared in the following manner: fasten the device 10 to either a ceiling surface 85 or wall surface 115. The mounting to a wall surface 115 would utilize wall mounting brackets 120. Should the functionality of a light fixture 105 be desired, it would be fastened to the bottom member 30 using support chains 110 as needed. Electrical wiring 90 would be routed from the electrical junction box 80, through the wire channels 95, 96, 97, along the support chains 110, and to the light fixture 105. At this point in time, the device 10 is ready for use.

During utilization of the score tracking device for billiards 10, the following procedure would be initiated: players would adjust the billiard balls 70 in either the "ones" section 55, the "tens" section 60, and/or the "hundreds" section 65 in a sequential manner to represent the score of the billiard game. Adjustment is made by the player's hands or the tipped end of a cue stick. Scored play may include of a match of eight- or nine-ball competing in a race to a particular number. The device 10 may be used to keep track of a numerical score for snooker, straight pool, or three (3) cushion billiards. It may also be used to keep track of bets or wages.

After use of the score tracking device for billiards 10, the billiard balls 70 are returned to their initial position, representing a zero (0) score.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A score tracking device, comprising:

a frame assembly, comprising:

an upper member;

a middle member;

a lower member;

a first end vertical member interconnecting first ends of each said upper member, middle member, and lower member;

a second end vertical member interconnecting second ends of each said upper member, middle member, and lower member;

a first intermediate member interconnecting a first intermediate position of each said upper member, middle member, and lower member; and, a second intermediate member interconnecting a second intermediate position of each said upper member, middle member, and lower member;

wherein an area bound between said upper member, said lower member, said first end vertical member, and said first intermediate member is defined as a "hundreds" section;

wherein an area bound between said upper member, said lower member, said first intermediate member, and said second intermediate member is defined as a "tens" section; and, wherein an area bound between said upper member, said lower member, said second end vertical member, and said second intermediate member is defined as a "ones" section;

a plurality of upper "hundreds" balls each captured within and capable of traversing along said "hundreds" section located above said middle member;

a plurality of lower "hundreds" balls each captured within and capable of traversing along said "hundreds" section located below said middle member;

a plurality of upper "tens" balls each captured within and capable of traversing along said "tens" section located above said middle member;

a plurality of lower "tens" balls each captured within and capable of traversing along said "tens" section located below said middle member;

a plurality of upper "ones" balls each captured within and capable of traversing along said "ones" section located above said middle member; and, a plurality of lower "ones" balls each captured within and capable of traversing along said "ones" section located below said middle member;

wherein said middle member bisects said "hundreds" section, said "tens" section, and said "ones" section.

2. The device of claim 1, further comprising:

a first track located along a lower surface of said upper member;

a second track located along an upper surface of said middle member;

a third track located along a lower surface of said middle member; and, a fourth track located along an upper surface of said lower member;

wherein said first track and said second track are coaligned; and, wherein said third track and said fourth track are coaligned.

3. The device of claim 2, further comprising:

a first upper plurality of equidistantly spaced depressions located along said second track within said "hundreds" section, each capable of retaining one of said plurality of upper "hundreds" balls therein;

a second upper plurality of equidistantly spaced depressions located along said second track within said "tens" section, each capable of retaining one of said plurality of upper "tens" balls therein;

a third upper plurality of equidistantly spaced depressions located along said second track within said "ones" section, each capable of retaining one of said plurality of upper "ones" balls therein;

a first lower plurality of equidistantly spaced depressions located along said fourth track within said "hundreds" section, each capable of retaining one of said plurality of lower "hundreds" balls therein;

a second lower plurality of equidistantly spaced depressions located along said fourth track within said "tens" section, each capable of retaining one of said plurality of lower "tens" balls therein; and, a third lower plurality of equidistantly spaced depressions located along said fourth track within said "ones" section, each capable of retaining one of said plurality of lower "ones" balls therein;

wherein:

said first upper plurality of equidistantly spaced depressions are spaced such that adjacent ones of said plurality of upper "hundreds" balls are not in contact;

said second upper plurality of equidistantly spaced depressions are spaced such that adjacent ones of said plurality of upper "tens" balls are not in contact;

said third upper plurality of equidistantly spaced depressions are spaced such that adjacent ones of said plurality of upper "ones" balls are not in contact;

said first lower plurality of equidistantly spaced depressions are spaced such that adjacent ones of said plurality of lower "hundreds" balls are not in contact;

said second lower plurality of equidistantly spaced depressions are spaced such that adjacent ones of said plurality of lower "tens" balls are not in contact; and, said third lower plurality of equidistantly spaced depressions are spaced such that adjacent ones of said plurality of lower "ones" balls are not in contact.

4. The device of claim 3, wherein said "tens" section and said "ones" section are equal to each other in area.

5. The device of claim 3, further comprising:

a first upper reinforcing member affixed between said upper member, said middle member, and said first end vertical member;

a first lower reinforcing member affixed between said lower member, said middle member, and said first end vertical member;

a second upper reinforcing member affixed between said upper member, said middle member, and said second end vertical member; and, a second lower reinforcing member affixed between said lower member, said middle member, and said second end vertical member.

6. The device of claim 3, further comprising a light fixture capable of being attached to and suspending from a lower surface of said lower member.

7. The device of claim 3, further comprising:

an upper wire channel located along an upper surface of said upper member;

a first end wire channel located along a vertical bisecting centerline within said first end vertical member and in fluid communication with said upper wire channel; and, a second end wire channel located along a vertical bisecting centerline within said second end vertical member and in fluid communication with said upper wire channel.

8. The device of claim 3, further comprising a plurality of mounting brackets attached to a rear side of said upper member.

9. The device of claim 3, wherein said frame assembly is approximately sixty inches in length, seven inches in height, and two and a half inches in width.

10. The device of claim 3, wherein said frame assembly further comprises a bonnet affixed to an upper surface of said upper member.

11. The device of claim 10, further comprising:

an upper wire channel located along an upper surface of said bonnet;

a first end wire channel located along a vertical bisecting centerline within said first end vertical member and in fluid communication with said upper wire channel; and, a second end wire channel located along a vertical bisecting centerline within said second end vertical member and in fluid communication with said upper wire channel.

12. The device of claim 10, further comprising a plurality of mounting brackets attached to a rear side of said bonnet.

13. The device of claim 10, wherein said frame assembly is approximately sixty inches in length, seven inches in height, and two and a half inches in width.

14. A score tracking device, comprising:

a frame assembly, comprising:

an upper member;

a middle member;

a lower member;

a first end vertical member interconnecting first ends of each said upper member, middle member, and lower member;

a second end vertical member interconnecting second ends of each said upper member, middle member, and lower member;

a first intermediate member interconnecting a first intermediate position of each said upper member, middle member, and lower member; and, a second intermediate member interconnecting a second intermediate position of each said upper member, middle member, and lower member;

wherein an area bound between said upper member, said lower member, said first end vertical member, and said first intermediate member is defined as a "hundreds" section;

wherein an area bound between said upper member, said lower member, said first intermediate member, and said second intermediate member is defined as a "tens" section; and, wherein an area bound between said upper member, said lower member, said second end vertical member, and said second intermediate member is defined as a "ones" section;

at least one stand affixed to a bottom of said frame assembly;

a plurality of upper "hundreds" balls each captured within and capable of traversing along said "hundreds" section located above said middle member;

a plurality of lower "hundreds" balls each captured within and capable of traversing along said "hundreds" section located below said middle member;

a plurality of upper "tens" balls each captured within and capable of traversing along said "tens" section located above said middle member;

a plurality of lower "tens" balls each captured within and capable of traversing along said "tens" section located below said middle member;

a plurality of upper "ones" balls each captured within and capable of traversing along said "ones" section located above said middle member; and, a plurality of lower "ones" balls each captured within and capable of traversing along said "ones" section located below said middle member;

wherein said middle member bisects said "hundreds" section, said "tens" section, and said "ones" section.

15. The device of claim 14, further comprising:

a first track located along a lower surface of said upper member;

a second track located along an upper surface of said middle member;

a third track located along a lower surface of said middle member; and, a fourth track located along an upper surface of said lower member;

wherein said first track and said second track are coaligned; and, wherein said third track and said fourth track are coaligned.

16. The device of claim 15, further comprising:

a first upper plurality of equidistantly spaced depressions located along said second track within said "hundreds" section, each capable of retaining one of said plurality of upper "hundreds" balls therein;

a second upper plurality of equidistantly spaced depressions located along said second track within said "tens" section, each capable of retaining one of said plurality of upper "tens" balls therein;

a third upper plurality of equidistantly spaced depressions located along said second track within said "ones" section, each capable of retaining one of said plurality of upper "ones" balls therein;

a first lower plurality of equidistantly spaced depressions located along said fourth track within said "hundreds" section, each capable of retaining one of said plurality of lower "hundreds" balls therein;

a second lower plurality of equidistantly spaced depressions located along said fourth track within said "tens" section, each capable of retaining one of said plurality of lower "tens" balls therein; and, a third lower plurality of equidistantly spaced depressions located along said fourth track within said "ones" section, each capable of retaining one of said plurality of lower "ones" balls therein;

wherein:

said first upper plurality of equidistantly spaced depressions are spaced such that adjacent ones of said plurality of upper "hundreds" balls are not in contact;

said second upper plurality of equidistantly spaced depressions are spaced such that adjacent ones of said plurality of upper "tens" balls are not in contact;

said third upper plurality of equidistantly spaced depressions are spaced such that adjacent ones of said plurality of upper "ones" balls are not in contact;

said first lower plurality of equidistantly spaced depressions are spaced such that adjacent ones of said plurality of lower "hundreds" balls are not in contact;

said second lower plurality of equidistantly spaced depressions are spaced such that adjacent ones of said plurality of lower "tens" balls are not in contact; and, said third lower plurality of equidistantly spaced depressions are spaced such that adjacent ones of said plurality of lower "ones" balls are not in contact.

17. The device of claim 16, wherein said "tens" section and said "ones" section are equal to each other in area.

18. The device of claim 16, further comprising:

a first upper reinforcing member affixed between said upper member, said middle member, and said first end vertical member;

a first lower reinforcing member affixed between said lower member, said middle member, and said first end vertical member;

a second upper reinforcing member affixed between said upper member, said middle member, and said second end vertical member; and, a second lower reinforcing member affixed between said lower member, said middle member, and said second end vertical member.

19. The device of claim 16, wherein said frame assembly is approximately sixty inches in length, seven inches in height, and two and a half inches in width.

20. The device of claim 16, wherein said frame assembly further comprises a bonnet affixed to an upper surface of said upper member.

* * * * *